US011763967B2

(12) United States Patent
Yonezawa et al.

(10) Patent No.: US 11,763,967 B2
(45) Date of Patent: Sep. 19, 2023

(54) METHOD OF MANUFACTURING THERMISTOR

(71) Applicant: MITSUBISHI MATERIALS CORPORATION, Tokyo (JP)

(72) Inventors: Takehiro Yonezawa, Naka (JP); Satoko Higano, Naka (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 135 days.

(21) Appl. No.: 17/429,758

(22) PCT Filed: Jan. 31, 2020

(86) PCT No.: PCT/JP2020/003618
§ 371 (c)(1),
(2) Date: Aug. 10, 2021

(87) PCT Pub. No.: WO2020/170757
PCT Pub. Date: Aug. 27, 2020

(65) Prior Publication Data

US 2022/0130579 A1 Apr. 28, 2022

(30) Foreign Application Priority Data

Feb. 22, 2019 (JP) ..... 2019-030527

(51) Int. Cl.
*H01C 7/00* (2006.01)
*H01C 1/142* (2006.01)
(Continued)

(52) U.S. Cl.
CPC ..... *H01C 7/008* (2013.01); *H01C 1/142* (2013.01); *H01C 17/006* (2013.01); *H01C 17/06553* (2013.01)

(58) Field of Classification Search
CPC ..... H01C 7/008; H01C 1/142; H01C 17/006; H01C 17/06553
See application file for complete search history.

(56) References Cited

U.S. PATENT DOCUMENTS 5,339,068 A 8/1994 Tsunoda et al.
8,154,379 B2 * 4/2012 Theissl ..... H01C 1/1406 338/307
(Continued)

FOREIGN PATENT DOCUMENTS

CN 1334575 A 2/2002
CN 1588574 A 3/2005
(Continued)

OTHER PUBLICATIONS

JPH07201527, Nakajima, machine translation. (Year: 1995).*
(Continued)

*Primary Examiner* — Kyung S Lee
(74) *Attorney, Agent, or Firm* — Locke Lord LLP; James E. Armstrong, IV; Nicholas J. DiCeglie, Jr.

(57) ABSTRACT

The present invention is provided with a base electrode layer forming step of forming a base electrode layer on both surfaces of a thermistor wafer formed of a thermistor material, a chip forming step of obtaining a thermistor chip with a base electrode layer by cutting the thermistor wafer to form chips, a protective film forming step of forming a protective film formed of an oxide on an entire surface of the thermistor chip with a base electrode layer, a cover electrode layer forming step of forming a cover electrode layer by applying and sintering a conductive paste on an end surface of the thermistor chip with a base electrode layer, and a conduction heat treatment step of performing a heat treatment such that
(Continued)

the base electrode layer and the cover electrode layer are electrically conductive, in which the electrode portion is formed.

13 Claims, 4 Drawing Sheets

(51) Int. Cl.
*H01C 17/00* (2006.01)
*H01C 17/065* (2006.01)

(56) References Cited

U.S. PATENT DOCUMENTS

| | | | | |
|---|---|---|---|---|
| 9,230,718 | B2 * | 1/2016 | Tsuchida | H01C 7/008 |
| 2001/0023735 | A1 | 9/2001 | Sawamura | |
| 2017/0309389 | A1 * | 10/2017 | Sato | H01F 27/29 |

FOREIGN PATENT DOCUMENTS

| | | | |
|---|---|---|---|
| CN | 1588575 | A | 3/2005 |
| CN | 101740188 | A | 6/2010 |
| CN | 102034580 | A | 4/2011 |
| CN | 102403077 | A | 4/2012 |
| CN | 102627445 | A | 8/2012 |
| CN | 102682941 | A | 9/2012 |
| CN | 102682942 | A | 9/2012 |
| CN | 102682944 | A | 9/2012 |
| CN | 102693795 | A | 9/2012 |
| CN | 102971808 | A | 3/2013 |
| CN | 104051095 | A | 9/2014 |
| CN | 104064297 | A | 9/2014 |
| CN | 104086160 | A | 10/2014 |
| CN | 105679478 | A | 6/2016 |
| CN | 107346690 | A | 11/2017 |
| CN | 108395217 | A | 8/2018 |
| JP | S61-055303 | U | 4/1986 |
| JP | H03-250603 | A | 11/1991 |
| JP | H06-295803 | A | 10/1994 |
| JP | H07-201527 | A | 8/1995 |
| JP | H08-236306 | A | 9/1996 |
| JP | H09-186002 | A | 7/1997 |
| JP | 2001-044006 | A | 2/2001 |
| JP | 2004-128488 | A | 4/2004 |
| JP | 3661160 | B2 | 6/2005 |
| JP | 2006-080322 | A | 3/2006 |
| JP | 2006-190914 | A | 7/2006 |
| JP | 2006-324513 | A | 11/2006 |
| JP | 2014-053551 | A | 3/2014 |
| JP | 2017-147336 | A | 8/2017 |
| JP | 2017-195309 | A | 10/2017 |
| JP | 2017-199797 | A | 11/2017 |
| JP | 2018-014413 | A | 1/2018 |
| JP | 2018-053292 | A | 4/2018 |

OTHER PUBLICATIONS

International Search Report dated Apr. 21, 2020, issued for PCT/JP2020/003618 and English translation thereof.

Office Action dated May 27, 2022, issued for Chinese Patent Application No. 202080014946.7 and English machine translation obtained by Global Dossier dated Aug. 8, 2022.

Notice of Allowance dated Nov. 21, 2022, issued for CN202080014946.7 and English translation thereof.

Decision of Rejection dated Dec. 13, 2022, issued for JP2019-030527 and English translation thereof.

* cited by examiner (a)

(b)

(a)

(b)

METHOD OF MANUFACTURING THERMISTOR

TECHNICAL FIELD

This invention relates to a method of manufacturing a thermistor, which includes a thermistor chip formed of a thermistor material, a protective film formed on a surface of the thermistor chip, and electrode portions formed on each of both end portions of the thermistor chip.

Priority is claimed on Japanese Patent Application No. 2019-030527, filed in Japan on Feb. 22, 2019, the content of which is incorporated herein by reference.

BACKGROUND ART

The thermistor (thermistor material) described above has a characteristic by which the electrical resistance thereof changes according to the temperature and is applied in the temperature compensation of various electronic devices, in temperature sensors, and the like. In particular, recently, chip-type thermistors mounted on circuit boards have been widely used.

The thermistor described above has a structure formed of a thermistor chip and a pair of electrode portions at both ends of the thermistor chip.

The thermistor chip has properties of being weak against acids and alkalis and being easily reduced and, when the composition thereof changes due to a reaction with the above, there is a concern that the characteristics thereof may change. For this reason, for example, as shown in Patent Document 1, a technique for forming a protective film on the surface of the thermistor chip was proposed. There is a demand for the protective film to have resistance to a plating solution, environmental resistance, insulation, and the like, in order to suppress deterioration of the thermistor chip during subsequent steps and use.

In Patent Document 1, a protective film formed of glass is formed by sintering a glass paste applied to the surface of the thermistor chip.

In addition, since electrode portions are formed on both ends of the thermistor chip, a protective film is not formed on the end surfaces of the thermistor where the electrode portions are formed.

Here, the electrode portions are formed by, for example, sintering a conductive paste including conductive materials such as Ag applied to both ends of the thermistor chip. In addition, a Ni plating layer or a Sn plating layer is formed on the surfaces of the electrode portions formed of the sintered material.

In the related art, in a case of manufacturing the thermistors described above, usually, a protective film was formed on both surfaces of a thermistor wafer formed of a thermistor material, the result was then cut into strip shapes, then a protective film was further formed on the cut surfaces, the result was cut to form chips, then electrode portions were formed on both end surfaces of the thermistor chips (cut surfaces during chip formation), and a plating layer was formed on the surfaces of the electrode portions.

CITATION LIST

Patent Document

[Patent Document 1]
Japanese Unexamined Patent Application, First Publication No. H03-250603

SUMMARY OF INVENTION

Technical Problem

Here, in a case where thermistor wafers are cut into strip shapes as in the related art, the strip shaped thermistor materials are easily damaged during handling and it is difficult to efficiently manufacture the thermistors. In particular, recently, there has been a demand for smaller thermistors, the cross-sectional area of the strips has been reduced, and there is a tendency for damage to occur more easily.

In addition, when an electrode portion formed of a sintered material is formed by forming a chip and then applying and sintering a conductive paste thereon, uneven application of the conductive paste or contamination of foreign matter in the conductive paste may produce pores in the electrode portions and create a porous structure. In a case where a plating layer is formed on such an electrode portion, there were concerns that the plating solution may penetrate into the electrode portion and the thermistor chip and the plating solution may come into contact to cause deterioration of the thermistor chip. In addition, there were concerns that the plating metal may precipitate at the interface between the thermistor chip and the electrode portions and the resistance value may change significantly before and after plating.

This invention was made in view of the circumstances described above and has an object of providing a method of manufacturing a thermistor which is able to manufacture a thermistor having stable characteristics, with which the generation of damage or the like during manufacturing is suppressed, it is possible to stably manufacture the thermistor, and, even in a case where a plating layer is formed on a surface of an electrode portion, it is possible to suppress penetration of a plating solution inside the electrode portion.

Solution to Problem

In order to solve the problem described above, the method of manufacturing a thermistor of the present invention is a method of manufacturing a thermistor which includes a thermistor chip having a columnar shape, a protective film formed on a surface of the thermistor chip, and an electrode portion formed on each of both end portions of the thermistor chip, the method including a base electrode layer forming step of forming a base electrode layer by applying and sintering a conductive paste on both surfaces of a thermistor wafer formed of a thermistor material, a chip forming step of obtaining a thermistor chip with a base electrode layer by cutting the thermistor wafer on which the base electrode layer is formed to form chips, a protective film forming step of forming a protective film formed of an oxide on an entire surface of the thermistor chip with a base electrode layer, a cover electrode layer forming step of forming a cover electrode layer by applying and sintering a conductive paste on a surface of the protective film formed on an end surface of the thermistor chip with a base electrode layer, and a conduction heat treatment step of performing a heat treatment such that the base electrode layer and the cover electrode layer are electrically conductive, in which an electrode portion having the base electrode layer and the cover electrode layer is formed.

According to the method of manufacturing a thermistor of the present invention, as described above, after forming the base electrode layer on the surface of a thermistor wafer formed of a thermistor material, the result is cut to form chips, thus, the thermistor material is not handled in a strip shape state and it is possible to suppress the generation of damage or the like. Thus, handling during manufacturing is improved and it is possible to manufacture a thermistor efficiently and with high yield.

In addition, in the method of manufacturing a thermistor of the present invention, in the protective film forming step, a protective film formed of oxide is formed on the entire surface of the thermistor chip with a base electrode layer, thus, it is possible to reliably protect the thermistor chip with the protective film.

Furthermore, since the method of manufacturing a thermistor of the present invention is provided with a cover electrode layer forming step and a conduction heat treatment step, the electrode portion has a two-layer structure of the base electrode layer and the cover electrode layer, the pores in the base electrode layer and the pores of the cover electrode layer do not communicate, and, in a subsequent plating step, the penetration of a plating solution is prevented at the interface between the cover electrode layer and the base electrode layer and it is possible to suppress contact between the thermistor chip and the plating solution. In addition, it is possible to suppress the precipitation of a plating metal at the interface between the thermistor chip and the electrode portion.

In addition, since a conduction heat treatment step of performing a heat treatment such that the base electrode layer and the cover electrode layer are electrically conductive is provided, even when a protective film is formed between the base electrode layer and the cover electrode layer, it is possible to make the base electrode layer and the cover electrode layer electrically conductive, and it is possible to ensure the function of the electrode portion.

Here, in the method of manufacturing a thermistor of the present invention, the protective film is preferably formed of a silicon oxide.

In this case, since the protective film is formed of a silicon oxide, the environmental resistance is excellent, it is possible to reliably form a cover electrode layer on the surface of this protective film, and it is possible to stably form the electrode portion having a two-layer structure of the base electrode layer and the cover electrode layer.

In addition, in the method of manufacturing a thermistor of the present invention, the protective film forming step preferably forms the protective film by immersing the thermistor chip with a base electrode layer in a reaction solution including a silicon alkoxide, water, an organic solvent, and an alkali, and precipitating a silicon oxide on a surface of the thermistor chip with a base electrode layer by hydrolysis and a polycondensation reaction of the silicon alkoxide.

In this case, since the silicon oxide is precipitated by the polymerization of the hydrolyzed matter of the silicon alkoxide starting from the terminal oxygen and hydroxyl groups on the surface of the thermistor chip, the adhesion between the thermistor chip and the protective film is excellent. In addition, since the silicon oxide precipitates from the surface of the thermistor chip, the coverage of corner parts and uneven parts is excellent. Thus, there is no deterioration in the characteristics of the thermistor chip and it is possible to manufacture a thermistor which is able to be used stably.

Furthermore, in the method of manufacturing a thermistor of the present invention, the base electrode layer forming step may be configured to form a conductive oxide layer on a surface of the thermistor wafer and then apply and sinter a conductive paste having a metal powder thereon.

In such a case, forming the conductive oxide layer on the surface of the thermistor wafer makes it possible to improve the bonding reliability between the thermistor chip and the base electrode layer.

In addition, in the method of manufacturing a thermistor of the present invention, the base electrode layer forming step may be configured to form the base electrode layer by applying and sintering a glass-filled metal paste containing metal powder and glass powder.

In such a case, since the base electrode layer is formed by sintering the glass-filled metal paste, it is possible to improve the adhesion of the base electrode layer.

Furthermore, in the method of manufacturing a thermistor of the present invention, the cover electrode layer forming step may be configured to form the cover electrode layer by applying and sintering a glass-filled metal paste containing metal powder and glass powder.

In such a case, since the cover electrode layer is formed by sintering the glass-filled metal paste, in the conduction heat treatment step, it is possible to efficiently eliminate at least a part of the protective film by the reaction between the glass and the protective film and to make the base electrode layer and the cover electrode layer sufficiently conductive.

Furthermore, the method of manufacturing a thermistor of the present invention may be configured to have a chamfering step of chamfering the thermistor chip with a base electrode layer after the chip forming step, in which the protective film forming step is carried out after the chamfering step.

In such a case, since there is a chamfering step of chamfering the thermistor chip with a base electrode layer after the chip forming step, it is possible to suppress the generation of cracks and chips at the corner parts of the thermistor chip and to manufacture a thermistor more efficiently and with higher yield.

Advantageous Effects of Invention

According to the present invention, it is possible to provide a method of manufacturing a thermistor which is able to manufacture a thermistor having stable characteristics, with which the generation of damage or the like during manufacturing is suppressed, it is possible to stably manufacture the thermistor, and, even in a case where a plating layer is formed on a surface of an electrode portion, it is possible to suppress penetration of a plating solution inside the electrode portion.

DESCRIPTION OF EMBODIMENTS

Figure 1:
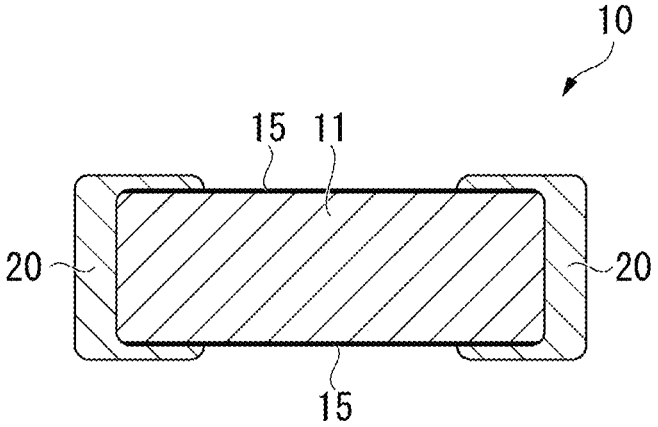
FIG. 1 is a schematic cross-sectional explanatory diagram of a thermistor manufactured by a method of manufacturing a thermistor according to the present embodiment.

A description will be given below of embodiments of the present invention with reference to the attached drawings.

Here, each of the embodiments shown below are specifically described in order to better understand the gist of the invention and do not limit the present invention unless otherwise specified. In addition, in the drawings used in the following description, in order to make the characteristics of the present invention easy to understand, for convenience, the main parts may be shown after being enlarged and the dimensional ratios of the respective components may not always be the same as in practice.

As shown in FIG. 1, a thermistor 10 according to the present embodiment has a prismatic shape, for example, and is provided with a thermistor chip 11, a protective film 15 formed on the surface of the thermistor chip 11, and electrode portions 20 formed on each of both end portions of the thermistor chip 11.

Here, as shown in FIG. 1, the electrode portions 20 are formed to be in direct contact with the thermistor chip 11.

The thermistor chip 11 has a characteristic by which the electrical resistance changes according to the temperature. The thermistor chip 11 has a low resistance to acids and alkalis and there is a concern that the composition may change due to a reduction reaction or the like and that the characteristics thereof may change significantly. Thus, in the present embodiment, the protective film 15 is formed in order to protect the thermistor chip 11.

There is a demand for the protective film 15 to have resistance to a plating solution, environmental resistance, and insulation. Therefore, in the present embodiment, the protective film 15 may be formed of a silicon oxide, specifically, $SiO_2$.

In addition, in the present embodiment, the thickness of the protective film 15 may be 50 nm or more. Due to a concern that the protective film may become discontinuous, the lower limit of the thickness of the protective film 15 is preferably 50 nm or more, and more preferably 100 nm or more. On the other hand, the upper limit of the thickness of the protective film 15 is preferably 3 μm or less, which is the limit of the erosion effect of the protective film 15 by the glass frit included in the electrode portion 20, and more preferably 2 μm or less from the viewpoints of stabilizing the erosion effect and suppressing variations in electrical resistance.

Figure 2:
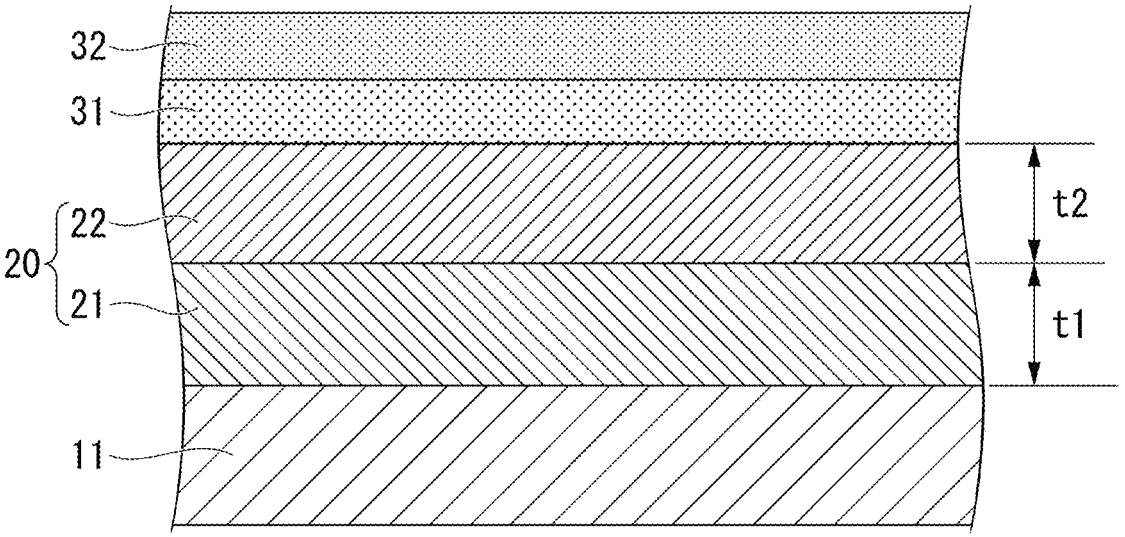
FIG. 2 is an enlarged explanatory diagram of the vicinity of an electrode portion of the thermistor shown in FIG. 1.

As shown in FIG. 2, the electrode portion 20 has a two-layer structure provided with a base electrode layer 21 formed on an end surface of the thermistor chip 11 and a cover electrode layer 22 laminated and arranged on the base electrode layer 21.

The base electrode layer 21 is formed by sintering a conductive paste (first conductive paste), as described below, and, in the present embodiment, may be formed of a sintered material of Ag. In this case, pores will be present inside the base electrode layer 21.

In addition, the cover electrode layer 22 is also formed by sintering a conductive paste, as described below, and, in the present embodiment, may be formed of a sintered material of Ag. In this case, pores will also be present inside the cover electrode layer 22.

Here, a thickness t1 of the base electrode layer 21 is set in a range of 2 μm or more and 20 μm or less. When less than 2 μm, the amount of glass is insufficient and the erosion of the protective film 15 tends to be insufficient, and, when the amount of glass in the paste is increased to ensure the erosion of the protective film 15, there are concerns that the percolation of the conductive particles may be insufficient and the resistance value may rise. On the other hand, when more than 20 the erosion effect of the protective film 15 due to the glass becomes saturated and there is material loss. The lower limit of the thickness t1 of the base electrode layer 21 is preferably 3 μm or more, and more preferably 5 μm or more. On the other hand, the upper limit of the thickness t1 of the base electrode layer 21 is preferably 15 μm or less, and more preferably 10 μm or less.

In addition, a thickness t2 of the cover electrode layer 22 is set in a range of 3 μm or more and 20 μm or less. When less than 3 μm, the amount of glass is insufficient and erosion of the protective film 15 tends to be insufficient and, when the amount of glass in the paste is increased to ensure the erosion of the protective film 15, the percolation of the conductive particles may be insufficient and the resistance value may rise while, on the other hand, when more than 20 the erosion effect of the protective film 15 due to the glass becomes saturated, there is material loss, the shape of the thermistor 10 swells to a large extent only at the electrode portions, and the shape is poor. The lower limit of the thickness t2 of the cover electrode layer 22 is preferably 4 μm or more, and more preferably 5 μm or more. On the other hand, the upper limit of the thickness t2 of the cover electrode layer 22 is preferably 15 μm or less, and more preferably 10 μm or less.

In addition, a Ni plating layer 31 is formed on the surface of the electrode portion 20 and a Sn plating layer 32 is formed so as to be laminated on the Ni plating layer 31.

Here, the Ni of the Ni plating layer 31 may penetrate into the electrode portion 20. This Ni penetrates to the interface between the base electrode layer 21 and the cover electrode layer 22, but does not reach the bonding interface between the thermistor chip 11 and the electrode portion 20 (base electrode layer 21).

Figure 3:
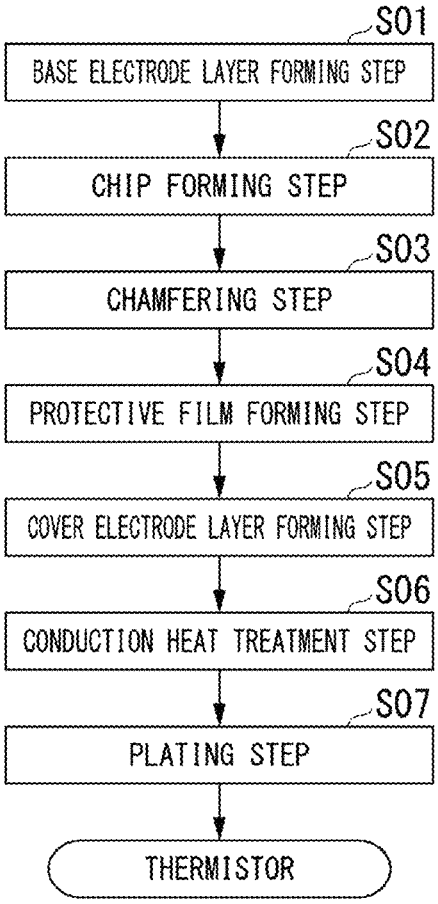
FIG. 3 is a flow diagram showing a method of manufacturing a thermistor according to the present embodiment.

Next, a description will be given of a method of manufacturing the thermistor 10, which is the present embodiment described above, using the flow diagram in FIG. 3.

(Base Electrode Layer Forming Step S01)

First, the base electrode layer 21 is formed on both surfaces of a thermistor wafer formed of a thermistor material.

In the present embodiment, first, a conductive oxide layer formed of a conductive oxide (in the present embodiment, ruthenium oxide) is formed on both surfaces of the thermistor wafer. Then, a conductive paste including Ag powder and glass powder is applied to this conductive oxide layer and sintered to form the base electrode layer 21. Due to this, the surface layer of the base electrode layer 21 is formed of a sintered material of Ag.

(Chip Forming Step S02)

Next, the thermistor wafer on which the base electrode layer 21 is formed is cut to form chips and the thermistor chip 11 on which the base electrode layer 21 is formed (referred to below as a thermistor chip with a base electrode layer) is obtained. That is, the thickness direction of the thermistor wafer becomes the thickness direction of the thermistor chip 11 and the base electrode layers 21 are each formed on both end surfaces of the thermistor chip 11 in the thickness direction.

(Chamfering Step S03)

Next, chamfering is carried out on the thermistor chip with a base electrode layer.

(Protective Film Forming Step S04)

Next, the protective film 15 is formed on the surface of the thermistor chip with a base electrode layer. In the present embodiment, the protective film 15 may be formed by immersing the thermistor chip with a base electrode layer in a reaction solution including a silicon alkoxide, water, an organic solvent, and an alkali and precipitating a silicon oxide ($SiO_2$) on the surface of the thermistor chip 11. At this time, the protective film 15 is also formed on the surface of the base electrode layer 21.

Here, the thickness of the formed protective film 15 is preferably 50 nm or more. A thickness of 100 μm or more is even more preferable.

As the silicon alkoxide, for example, it is possible to use ethyl orthosilicate or an oligomeric form of ethyl orthosilicate (Silicate 40 manufactured by Tama Chemicals Co., Ltd., or the like) or methyl orthosilicate or an oligomeric form of methyl orthosilicate (MS51 manufactured by Tama Chemicals Co., Ltd., or the like).

As organic solvents, it is possible to use water-soluble alcohols such as methanol, ethanol, and isopropanol, organic solvents such as ketones that are compatible with the above, and mixtures thereof.

As alkalis, it is possible to use inorganic alkalis such as sodium hydroxide, potassium hydroxide, and ammonia, amines such as ethanolamine and ethylenediamine, and the like.

(Cover Electrode Layer Forming Step S05)

Next, the cover electrode layer 22 is formed on the protective film 15 formed on the surface of the base electrode layer 21.

In the present embodiment, the cover electrode layer 22 is formed by sintering a conductive paste including Ag powder and glass powder applied to the surface of the protective film 15 and the cover electrode layer 22 is formed of a sintered material of Ag.

(Conduction Heat Treatment Step S06)

Next, a heat treatment is carried out such that the base electrode layer 21 and the cover electrode layer 22 are electrically conductive. In this conduction heat treatment step S06, at least a part of the protective film 15 interposed between the base electrode layer 21 and the cover electrode layer 22 disappears, such that the base electrode layer 21 and the cover electrode layer 22 are electrically conductive.

Here, in the conduction heat treatment step S06, it is necessary for the heating temperature to be the melting point or higher of both glass frit in the base electrode layer 21 and glass frit in the cover electrode layer 22. In other words, the optimum temperature changes depending on the glass frit used, but the temperature is preferably 50° C. or higher than the melting point of the glass frit in the cover electrode layer 22, and the temperature is more preferably 700° C. or higher from the viewpoint of sintering the Ag powder in the cover electrode layer 22. The upper limit of the heating temperature is preferably 900° C. or lower from the viewpoint of floating of the glass on the surface of the cover electrode layer 22. In addition, the melting point of the glass frit in the cover electrode layer 22 is preferably higher than the melting point of the glass frit in the base electrode layer 21.

The holding time at the heating temperature is preferably set in a range of 5 minutes or longer and 60 minutes or shorter. In addition, the atmosphere is preferably an air atmosphere.

The base electrode layer forming step S01, the protective film forming step S04, the cover electrode layer forming step S05, and the conduction heat treatment step S06 form the electrode portion 20 having a two-layer structure provided with the base electrode layer 21 and the cover electrode layer 22.

(Plating Step S07)

Next, a metal plating layer is formed on the surface of the electrode portion 20. In the present embodiment, the Ni plating layer 31 is formed on the surface of the electrode portion 20 and then the Sn plating layer 32 is formed so as to be laminated on the Ni plating layer 31. In the present embodiment, the Ni plating layer 31 and Sn plating layer 32 described above are formed by wet barrel plating.

Here, when forming the Ni plating layer 31, the plating solution penetrates into the inside of the electrode portion 20. In the present embodiment, since the pores inside the base electrode layer 21 do not communicate with the pores inside the cover electrode layer 22, the penetration of the plating solution is suppressed at the bonding interface between the base electrode layer 21 and the cover electrode layer 22.

Through the above steps, the thermistor 10 of the present embodiment is manufactured.

According to the method of manufacturing the thermistor 10 of the present embodiment configured as above, after forming the base electrode layer 21 on the surface of the thermistor wafer formed of a thermistor material, the thermistor wafer is cut to form chips, thus, the handling of thermistor material in strip shapes is eliminated and it is possible to suppress the generation of damage or the like. Thus, handling during manufacturing is improved and it is possible to manufacture the thermistor 10 efficiently and with high yield.

In addition, in the present embodiment, in the protective film forming step S04, the protective film 15 formed of oxide is formed on the entire surface of the thermistor chip 11 on which the base electrode layer 21 is formed, thus, it is possible to reliably protect the thermistor chip 11 with the protective film 15.

Furthermore, in the present embodiment, since the cover electrode layer forming step S05 and the conduction heat treatment step S06 are provided, the electrode portion 20 has a two-layer structure of the base electrode layer 21 and the cover electrode layer 22, the pores in the base electrode layer 21 and the pores in the cover electrode layer 22 do not communicate, and, in the plating step S07, the penetration of the plating solution is prevented at the interface between the cover electrode layer 22 and the base electrode layer 21 and it is possible to suppress the contact between the thermistor chip 11 and the plating solution. In addition, it is possible to suppress the precipitation of a plating metal at the interface between the thermistor chip 11 and the electrode portion 20.

In addition, in the present embodiment, since a conduction heat treatment step S06 of performing a heat treatment such that the base electrode layer 21 and the cover electrode layer 22 are electrically conductive is provided, even when the protective film 15 is formed between the base electrode layer 21 and the cover electrode layer 22, it is possible to make the base electrode layer 21 and the cover electrode layer 22 electrically conductive and to ensure the function as the electrode portion 20.

In addition, in the present embodiment, since the protective film 15 is formed of a silicon oxide, the environmental resistance is excellent, it is possible to reliably form the cover electrode layer 22 on the surface of this protective film 15, and it is possible to stably form the electrode portion 20 having a two-layer structure of the base electrode layer 21 and the cover electrode layer 22.

Furthermore, in the present embodiment, in the protective film forming step S04, the protective film 15 is formed by immersing the thermistor chip 11 on which the base electrode layer 21 is formed in a reaction solution including a silicon alkoxide, water, an organic solvent, and an alkali, and precipitating a silicon oxide on the surface of the thermistor chip 11 by hydrolysis and polycondensation reactions of the silicon alkoxide, thus, the silicon oxide is precipitated by the polymerization of the hydrolyzed matter of the silicon alkoxide starting from the terminal oxygen and hydroxyl groups on the surface of the thermistor chip 11, such that the adhesion between the thermistor chip 11 and the protective film 15 is excellent. In addition, since the silicon oxide precipitates from the surface of the thermistor chip 11, the coverage of corner parts and uneven parts is excellent. Thus, there is no deterioration in the characteristics of thermistor chip 11 and it is possible to manufacture thermistors 10 which is able to be used stably.

In addition, in the present embodiment, the base electrode layer forming step S01 forms the base electrode layer 21 by forming a conductive oxide layer formed of a conductive oxide (ruthenium oxide) on the surface of the thermistor wafer and applying and sintering a conductive paste on the conductive oxide layer, thus, it is possible to improve the bonding reliability between the thermistor chip 11 and the base electrode layer 21.

Furthermore, since a conductive paste including Ag powder and glass powder is used as the conductive paste, it is possible to improve the adhesion of the base electrode layer 21 and to form the surface layer of the base electrode layer 21 of a sintered material of Ag.

Furthermore, in the present embodiment, in the cover electrode layer forming step S05, since the cover electrode layer 22 is formed by applying and sintering a conductive paste including Ag powder and glass powder, in the conduction heat treatment step S06, it is possible to efficiently eliminate at least a part of the protective film 15 by the reaction between the glass and the protective film 15 and to make the base electrode layer 21 and the cover electrode layer 22 sufficiently conductive.

In addition, in the present embodiment, after the chip forming step S02, there is a chamfering step S03 in which the thermistor chip 11 on which the base electrode layer 21 is formed is chamfered, thus, it is possible to suppress the generation of cracks and chips at the corner parts of the thermistor chip 11 and to manufacture the thermistor 10 even more efficiently and with even higher yield.

Although one embodiment of the present invention was described above, the present invention is not limited thereto and appropriate changes are possible in a range not departing from the technical idea of the invention.

For example, in the present embodiment, a description was given in which the protective film is formed by immersing the thermistor chip in a reaction solution; however, the protective film may be formed by other means without being limited thereto. For example, a protective film may be formed by applying and sintering a glass paste.

Furthermore, in the present embodiment, a description was given in which the base electrode layer and the cover electrode layer are formed of a sintered material of Ag; however, without being limited thereto, for example, the above may be formed of a sintered material of an Ag alloy such as an Ag—Pd alloy, Au, Pt, Rh, Ir, or Ru oxides, or mixtures thereof. In addition, the base electrode layer and the cover electrode layer may be formed of different materials.

In addition, in the present embodiment, a description was given in which the protective film is formed of a silicon oxide; however, without being limited thereto, the above may be formed of other oxides such as aluminum oxide and titanium oxide.

EXAMPLES

A description will be given of confirmation experiments performed to confirm the effectiveness of the present invention.

An ethanol dispersion solution of $RuO_2$ powder was spin-applied to both surfaces of a thermistor wafer of 38×55 mm and 0.36 mm thickness, and, after baking at 250° C., a conductive oxide layer was formed.

Next, the base electrode layer was formed on the surface of the conductive oxide layer by printing by screen printing and baking a conductive paste including Ag powder and glass powder (weight ratio, Ag:glass=9:1).

The thermistor wafer with the base electrode layer formed as described above was cut into 0.18 mm squares by dicing to form chips.

After the chips were formed, chamfering was carried out by barrel processing.

After the chamfering, the thermistor chip was placed in a water-ethanol mixed solvent and 5.2 g of ethyl orthosilicate and 16.6 g of NaOH aqueous solution (0.2 mol/L) were added thereto while stirring to form a protective film formed of a silicon oxide on the entire surface of the thermistor chip.

In order to improve the strength and adhesion of the protective film, the film was baked at 700° C. after being formed and the formation and baking were repeatedly carried out to set the film thickness of the protective film to 1 μm.

Conductive paste including Ag powder and glass powder (weight ratio, Ag:glass=97:3) was applied to both end surfaces of the thermistor chip on which the protective film was formed (the surface on which the base electrode layer was formed) and baking was performed under conditions of atmosphere: air, heating temperature: 750° C., and holding time at heating temperature: 10 minutes, to form the cover electrode layer. This baking treatment also serves as a conduction heat treatment.

After that, a Ni plating layer and a Sn plating layer were formed by wet barrel plating.

Figure 4:
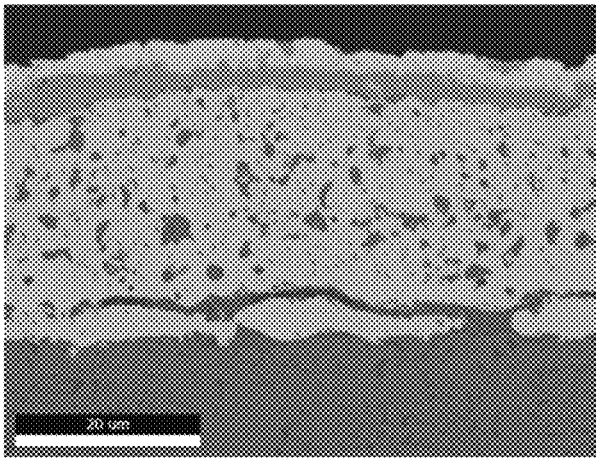
FIG. 4 is an observation photograph of the vicinity of the electrode portion of a thermistor manufactured in the Examples.
Figure 4:
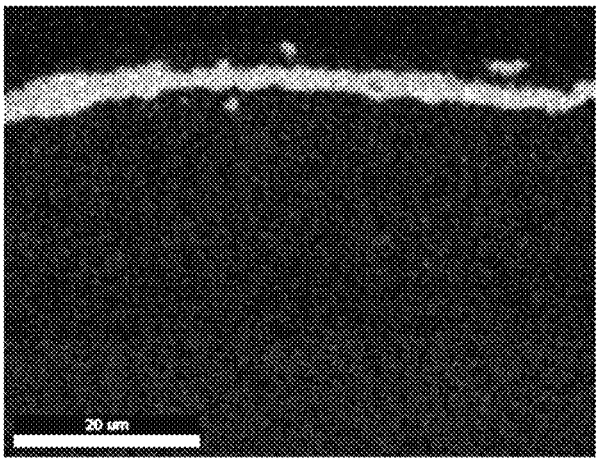
Figure 5:
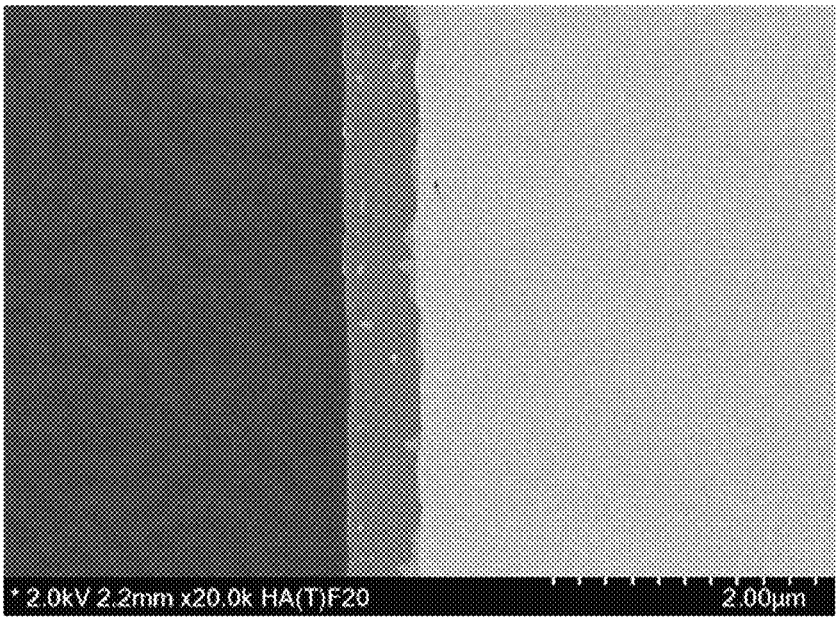
FIG. 5 is an observation photograph of an interface between the thermistor chip and the protective film of a thermistor manufactured in the Examples.
Figure 5:
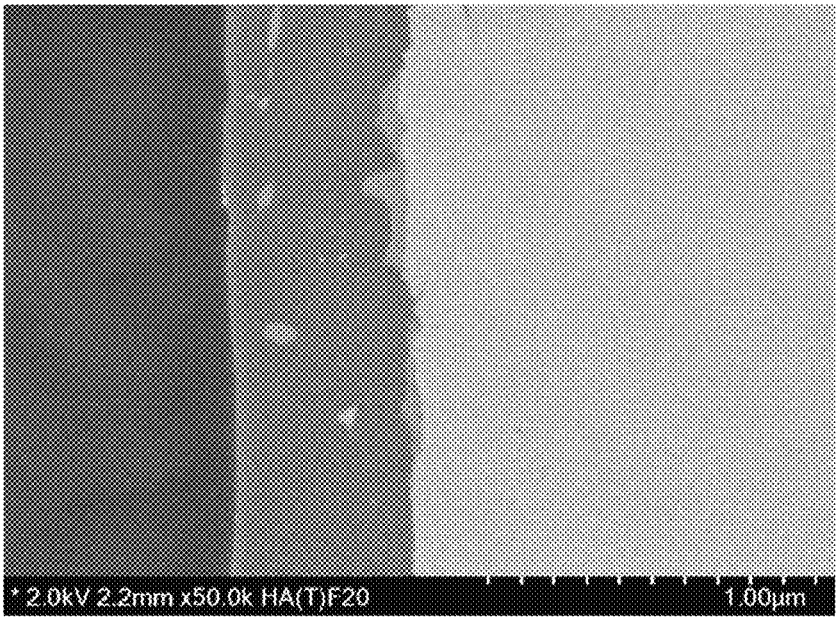

FIG. 4 shows the observation results of the electrode portion of the thermistor obtained by the above steps and FIG. 5 shows the observation results of the interface between the thermistor chip and the protective film.

As shown in the SEM image in FIG. 4(*a*), it was confirmed that a part of the protective film formed between the base electrode layer and the cover electrode layer was eliminated and that the base electrode layer and the cover electrode layer were conductive. In addition, as shown in the Ni mapping diagram in FIG. 4(*b*), it was confirmed that Ni penetration was stopped and there was no contact between the thermistor chip and the plating solution.

In FIG. 5, the magnification is 20000× in (a) and 50000× in (b). As shown in FIG. 5, it was confirmed that the protective film was formed in close contact with the thermistor chip in a region other than the electrode portion.

As described above, it was confirmed that, according to the present invention, it is possible to provide a method of manufacturing a thermistor which is able to manufacture a thermistor having stable characteristics, with which the generation of damage or the like during manufacturing is suppressed, it is possible to stably manufacture the thermistor, and, even in a case where a plating layer is formed on a surface of an electrode portion, it is possible to suppress penetration of a plating solution inside the electrode portion.

REFERENCE SIGNS LIST

10: Thermistor
11: Thermistor chip
15: Protective film
20: Electrode portion
21: Base electrode layer
22: Cover electrode layer

What is claimed is:

1. A method of manufacturing a thermistor which includes a thermistor chip having a columnar shape, a protective film formed on a surface of the thermistor chip, and an electrode portion formed on each of both end portions of the thermistor chip, the method comprising:

a base electrode layer forming step of forming a base electrode layer by applying and sintering a conductive paste on both surfaces of a thermistor wafer formed of a thermistor material;

a chip forming step of obtaining a thermistor chip with a base electrode layer by cutting the thermistor wafer on which the base electrode layer is formed to form chips;

a protective film forming step of forming a protective film formed of an oxide on an entire surface of the thermistor chip with a base electrode layer;

a cover electrode layer forming step of forming a cover electrode layer by applying and sintering a conductive paste on a surface of the protective film formed on an end surface of the thermistor chip with a base electrode layer; and a conduction heat treatment step of performing a heat treatment such that the base electrode layer and the cover electrode layer are electrically conductive, wherein the electrode portion having the base electrode layer and the cover electrode layer is formed, the protective film is formed of a silicon oxide, and the protective film forming step forms the protective film by immersing the thermistor chip with a base electrode layer in a reaction solution including a silicon alkoxide, water, an organic solvent, and an alkali, and precipitating a silicon oxide on a surface of the thermistor chip with a base electrode layer by hydrolysis and a polycondensation reaction of the silicon alkoxide.

2. The method of manufacturing a thermistor according to claim 1, wherein the base electrode layer forming step forms a conductive oxide layer on a surface of the thermistor wafer and then applies and sinters a conductive paste having metal powder.

3. The method of manufacturing a thermistor according to claim 1, wherein the base electrode layer forming step uses a glass-filled metal paste containing metal powder and glass powder as the conductive paste.

4. The method of manufacturing a thermistor according to claim 1, wherein the cover electrode layer forming step uses a glass-filled metal paste containing metal powder and glass powder as the conductive paste.

5. The method of manufacturing a thermistor according to claim 1, further comprising:

a chamfering step of chamfering the thermistor chip with a base electrode layer after the chip forming step, wherein the protective film forming step is carried out after the chamfering step.

6. The method of manufacturing a thermistor according to claim 2, wherein the base electrode layer forming step uses a glass-filled metal paste containing metal powder and glass powder as the conductive paste.

7. The method of manufacturing a thermistor according to claim 2, wherein the cover electrode layer forming step uses a glass-filled metal paste containing metal powder and glass powder as the conductive paste.

8. The method of manufacturing a thermistor according to claim 3, wherein the cover electrode layer forming step uses a glass-filled metal paste containing metal powder and glass powder as the conductive paste.

9. A method of manufacturing a thermistor which includes a thermistor chip having a columnar shape, a protective film formed on a surface of the thermistor chip, and an electrode portion formed on each of both end portions of the thermistor chip, the method comprising:

a base electrode layer forming step of forming a base electrode layer by applying and sintering a conductive paste on both surfaces of a thermistor wafer formed of a thermistor material;

a chip forming step of obtaining a thermistor chip with a base electrode layer by cutting the thermistor wafer on which the base electrode layer is formed to form chips;

a protective film forming step of forming a protective film formed of an oxide on an entire surface of the thermistor chip with a base electrode layer;

a cover electrode layer forming step of forming a cover electrode layer by applying and sintering a conductive paste on a surface of the protective film formed on an end surface of the thermistor chip with a base electrode layer; and a conduction heat treatment step of performing a heat treatment such that the base electrode layer and the cover electrode layer are electrically conductive, wherein the electrode portion having the base electrode layer and the cover electrode layer is formed, and the base electrode layer forming step forms a conductive oxide layer on a surface of the thermistor wafer and then applies and sinters a conductive paste having metal powder.

10. The method of manufacturing a thermistor according to claim 9, wherein the protective film is formed of a silicon oxide.

11. The method of manufacturing a thermistor according to claim 9, wherein the base electrode layer forming step uses a glass-filled metal paste containing metal powder and glass powder as the conductive paste.

12. The method of manufacturing a thermistor according to claim 9, wherein the cover electrode layer forming step uses a glass-filled metal paste containing metal powder and glass powder as the conductive paste.

13. The method of manufacturing a thermistor according to claim 9, further comprising:

a chamfering step of chamfering the thermistor chip with a base electrode layer after the chip forming step, wherein the protective film forming step is carried out after the chamfering step.

* * * * *